US007644768B2

(12) United States Patent
Haughom

(10) Patent No.: US 7,644,768 B2
(45) Date of Patent: Jan. 12, 2010

(54) SEPARATION DEVICE FOR MATERIAL FROM A DRILLING RIG SITUATED ON THE SEABED

(75) Inventor: Per Olav Haughom, Tonstad (NO)

(73) Assignee: Seabed Rig AS (NO)

( * ) Notice: Subject to any disclaimer, the term of this patent is extended or adjusted under 35 U.S.C. 154(b) by 0 days.

(21) Appl. No.: 11/910,823

(22) PCT Filed: Mar. 16, 2007

(86) PCT No.: PCT/NO2007/000103

§ 371 (c)(1),
(2), (4) Date: Jan. 2, 2008

(87) PCT Pub. No.: WO2007/108696

PCT Pub. Date: Sep. 27, 2007

(65) Prior Publication Data

US 2008/0156530 A1 Jul. 3, 2008

(30) Foreign Application Priority Data

Mar. 20, 2006 (NO) ..... 20061274

(51) Int. Cl.
*E21B 29/12* (2006.01)
*E21B 7/12* (2006.01)
*E21B 21/06* (2006.01)

(52) U.S. Cl. ..... 166/358; 166/357; 175/6; 175/66; 175/206

(58) Field of Classification Search ..... 166/357, 166/356, 358; 175/5, 50, 42
See application file for complete search history.

(56) References Cited

U.S. PATENT DOCUMENTS

| | | | | | |
|---|---|---|---|---|---|
| 2,781,185 | A | * | 2/1957 | Robbins | 175/52 |
| 2,972,388 | A | * | 2/1961 | Thornburg | 175/52 |
| 3,294,185 | A | * | 12/1966 | O'Neill et al. | 175/85 |
| 3,384,169 | A | * | 5/1968 | Leonard | 166/357 |
| 3,493,061 | A | * | 2/1970 | Gyongyosi | 175/52 |
| 3,503,443 | A | * | 3/1970 | Trageser et al. | 166/344 |
| 3,552,903 | A | * | 1/1971 | Townsend | 166/356 |
| 3,601,189 | A | * | 8/1971 | Weiss | 166/356 |
| 3,621,911 | A | * | 11/1971 | Baker et al. | 166/336 |
| 3,643,736 | A | * | 2/1972 | Talley, Jr. | 166/356 |
| 3,661,204 | A | * | 5/1972 | Blanding et al. | 166/356 |
| 3,670,830 | A | | 6/1972 | Van Der Wijden | |
| 4,043,407 | A | * | 8/1977 | Wilkins | 175/50 |
| 4,442,900 | A | * | 4/1984 | Padilla et al. | 166/342 |
| 4,456,071 | A | * | 6/1984 | Milgram | 166/356 |
| 4,502,551 | A | * | 3/1985 | Rule et al. | 175/6 |
| 4,558,744 | A | * | 12/1985 | Gibb | 166/335 |
| 4,865,490 | A | * | 9/1989 | Wallace | 405/303 |
| 5,460,227 | A | * | 10/1995 | Sidrim | 166/357 |
| 6,062,313 | A | * | 5/2000 | Moore | 166/357 |

(Continued)

FOREIGN PATENT DOCUMENTS

DE 2056064 B * 2/1977

(Continued)

*Primary Examiner*—Thomas A Beach
(74) *Attorney, Agent, or Firm*—Akerman Senterfitt

(57) ABSTRACT

A drilling rig device (1) situated on the seabed (11), where the drilling rig (1) is sealingly enclosed against the surroundings, wherein the drilling rig (1) is liquid-filled and provided with a separator (16) arranged to separate material (17) from the liquid.

7 Claims, 2 Drawing Sheets

U.S. PATENT DOCUMENTS

Figure 1:
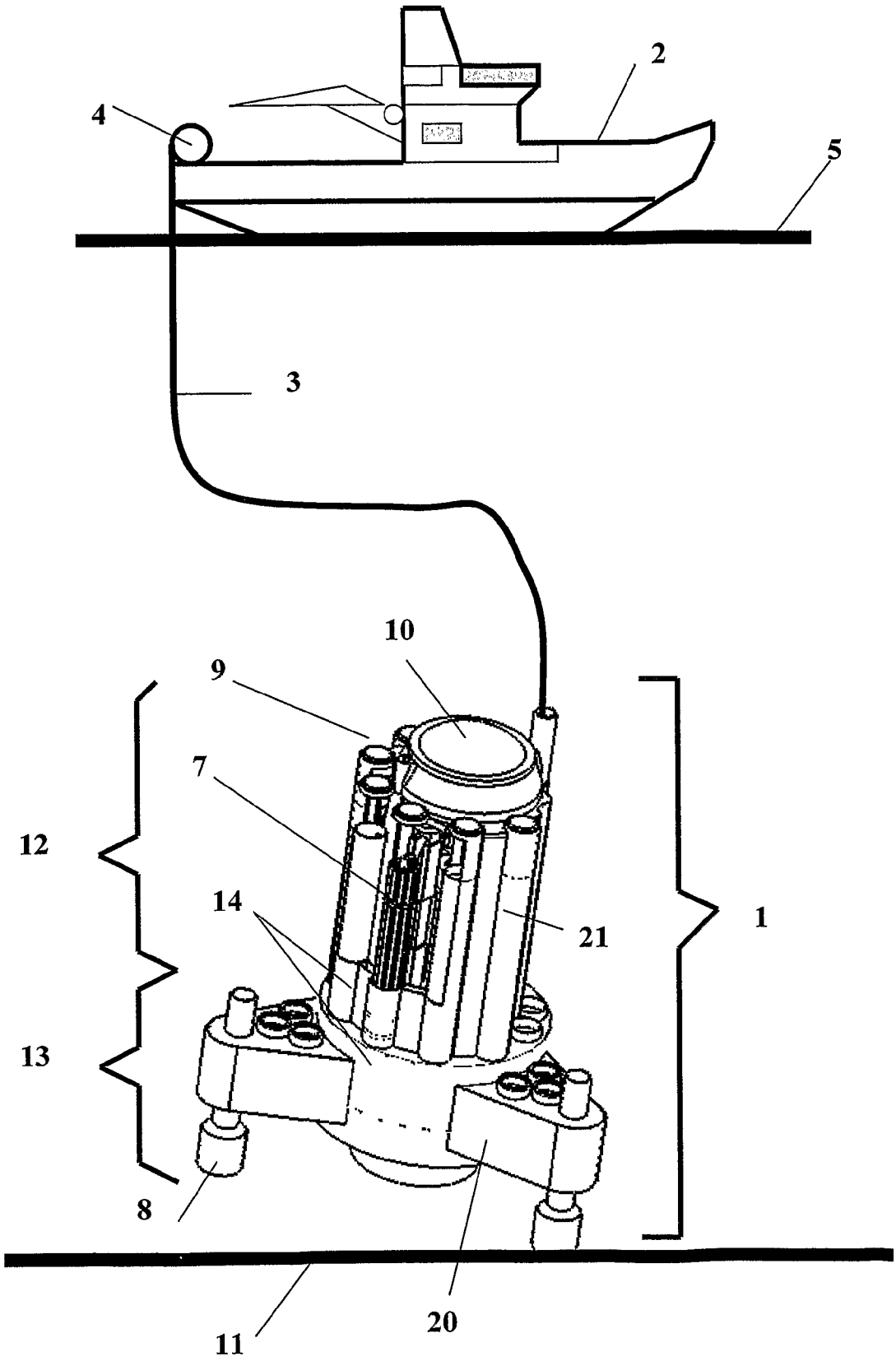

| | | | | |
|---|---|---|---|---|
| 6,216,799 | B1 * | 4/2001 | Gonzalez | 175/5 |
| 6,394,192 | B1 * | 5/2002 | Frazer | 175/58 |
| 6,457,526 | B1 * | 10/2002 | Dailey | 166/338 |
| 6,659,180 | B2 * | 12/2003 | Moss | 166/339 |
| 6,763,889 | B2 * | 7/2004 | Rytlewski et al. | 166/338 |
| 6,848,863 | B2 * | 2/2005 | Karayaka et al. | 405/211 |
| 7,093,661 | B2 * | 8/2006 | Olsen | 166/357 |
| 7,097,387 | B2 * | 8/2006 | Karayaka et al. | 405/211 |
| 7,152,682 | B2 * | 12/2006 | Hopper | 166/357 |
| 7,185,705 | B2 * | 3/2007 | Fontana | 166/356 |
| 7,380,614 | B1 * | 6/2008 | Williamson et al. | 175/6 |
| 2003/0106714 | A1 * | 6/2003 | Smith et al. | 175/6 |
| 2005/0109537 | A1 * | 5/2005 | Ayling | 175/5 |
| 2005/0117974 | A1 * | 6/2005 | Karayaka et al. | 405/211 |
| 2005/0145388 | A1 * | 7/2005 | Hopper | 166/357 |
| 2005/0173322 | A1 * | 8/2005 | Ostergaard | 210/170 |
| 2008/0093082 | A1 * | 4/2008 | Sheshtawy | 166/368 |

FOREIGN PATENT DOCUMENTS

| | | | |
|---|---|---|---|
| WO | WO 99/15758 | | 4/1999 |
| WO | WO 03/093625 | A2 * | 11/2003 |
| WO | WO 2004/018826 | A1 | 3/2004 |
| WO | WO 2007/004887 | A1 | 1/2007 |
| WO | WO 2007129899 | A1 * | 11/2007 |
| WO | WO 2008100149 | * | 8/2008 |
| WO | WO 2008130242 | * | 8/2008 |

* cited by examiner

SEPARATION DEVICE FOR MATERIAL FROM A DRILLING RIG SITUATED ON THE SEABED

FIELD OF THE INVENTION

This invention regards a device for separating material from a drilling rig situated on the seabed. More particularly, it regards a drilling rig situated on the seabed, where the drilling rig is sealingly enclosed against the surroundings. The drilling rig is liquid-filled and equipped with a separator arranged to separate material from the liquid in the drilling rig.

BACKGROUND OF THE INVENTION

It is common knowledge that oil and gas deposits in the earth's crust are recovered by drilling holes down to the deposit, to allow oil and gas deposits to be drained to the surface.

The equipment used to drill holes in the earth's crust primarily comprises a drilling derrick formed as a trussed steel structure. In the drilling derrick there is a wireline based drawworks for hoisting and deploying drill pipes. A great deal of auxiliary equipment is also used to handle drill pipes and to set casing in the borehole.

Floating or fixed platforms provided with the required drilling equipment are utilized to recover oil and gas deposits from great depths. These types of platforms are large and expensive structures, as the drilling equipment is large and heavy. In addition to the actual drilling equipment, marine risers must also be used to circulate drilling mud between the platform and the seabed during the drilling operation. Floating platforms also require heave compensation to accommodate wave motion against the platform relative to the seabed.

As an alternative to drilling from floating drilling platforms, the drilling rig may be arranged directly on the seabed, obviating the need for large and expensive platforms.

Today, the oil industry possesses a great deal of advanced equipment developed for remote-controlled subsea operations. This is technology that is available and may be used during a remote-controlled drilling operation where the drilling equipment is situated directly on the seabed.

Furthermore, it is necessary to meet the relatively strict requirements set by the authorities in connection with environmental pollution and the target of zero discharge to the environment.

Prior art does not provide a solution to these problems in connection with drilling rigs situated on the seabed.

BRIEF SUMMARY OF THE INVENTION

The object of the invention is to remedy or reduce at least one of the drawbacks of prior art.

The object is achieved in accordance with the invention, through the features stated in the description below and in the following claims.

A drilling rig in accordance with the invention is situated on the seabed, the drilling rig being sealingly enclosed against the surroundings, and it is characterized in that the drilling rig is liquid-filled and provided with a separator arranged to separate undesirable material from the liquid.

Preferably the hydrostatic pressure inside the drilling rig is lower than that outside the drilling rig, whereby liquid in the drilling rig is prevented from flowing out to the surroundings of the drilling rig.

The separator is connected to a container for separated material, the container, when filled, may be replaced with a new one and brought up to the surface for further processing of the separated material. The drilling rig may comprise several containers for separated material.

Preferably containers going into and out of the drilling rig are passed through lock arrangements.

Most preferably the separator forms part of a circulation system for the liquid in the drilling rig. The inlet of the circulation system communicates with one of the upper or lower part of the drilling rig, while the outlet of the circulation system communicates with the other of the upper or lower part of the drilling rig.

A circulation system in accordance with the invention comprises a pump and necessary piping and also control system in addition to the separator.

A device according to the invention provides a solution for handling e.g. discharges from drilling operations performed from the submerged drilling rig, as the water contained in the drilling rig is circulated through the separator.

DETAILED DESCRIPTION OF THE DRAWINGS

Figure 2:
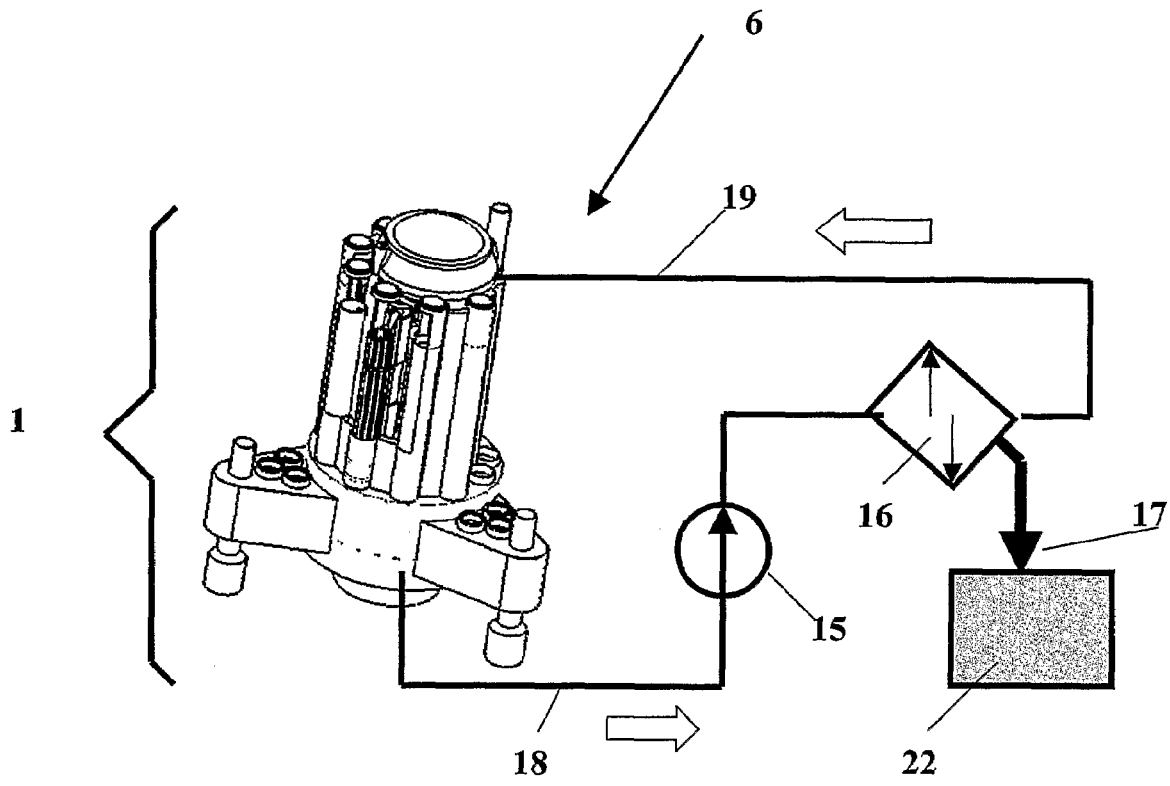

The following describes a non-limiting example of a preferred embodiment illustrated in the accompanying drawings, in which:

FIG. 1 is a principle drawing of an enclosed drilling rig with a connection to a surface vessel; and FIG. 2 is a principle drawing of a circulation system for the enclosed drilling rig.

DETAILED DESCRIPTION OF THE INVENTION

In the drawings, reference number 1 denotes an enclosed drilling rig constructed for placement on the seabed 11. The drilling rig comprises an upper section 12 and a lower section 13, a supporting section being located primarily in the lower section 13. The drilling rig 1 is sealingly enclosed against the surroundings.

The drilling rig 1 is controlled from a surface vessel 2 on the surface 5 of the sea. A tubing and cable connection 3 extends between the drilling rig 1 and the surface vessel 2, from a cable drum 4 and down to the drilling rig 1.

The drilling rig 1 is provided with suction anchors 8 which provide anchorage to the seabed 11. The suction anchors 8 are connected to the supporting section 14 via sections 20.

At the top of the drilling rig 1 there is provided a lock cover 10 for a drilling unit (not shown) and lock covers 9 for drill pipe cartridges 7. The drill pipe cartridges 7 are inserted into encased silos 21.

The upper section 12 comprises the drilling unit (not shown) with associated drill pipe handling equipment (not shown), together with drill pipe cartridge 7.

The lower section 13 comprises robotized handling systems (not shown) for connecting drill pipes, and also pumping systems (not shown).

A circulation system 6 for liquid in the drilling rig 1 is situated in one of the sections 20.

The entire drilling rig 1 is filled with water at a slight underpressure relative to the surrounding pressure, which prevents liquid in the drilling rig from flowing out to the surroundings.

From the lower section of the drilling rig 1 the liquid is circulated continuously through the circulation system 6, which comprises conduits 18, 19 with a pump 15 and separator 16. The separator 16 is arranged to separate undesirable material from the liquid in the drilling rig. The circulation system 6 comprises a control system (not shown) in addition to the separator 16, pump 15 and necessary piping 18, 19. The inlet of the circulation system communicates with one of the upper or lower part of the drilling rig, which the outlet of the circulation system communicates with the other of the upper or lower part of the drilling rig. In FIG. 2. the conduit 18. which forms the inlet of the circulation system 6, communicates with the lower section 13 of the drilling rig 1, and the conduit 19, which forms the outlet of the circulation system 6, communicates with the upper section 12. The device provides a solution for handling, for example, discharges from drilling operations performed by the submerged drilling rig, as the water contained in the drilling rig is circulated through the separator.

Separated material 17 is transferred from the separator 16 to a closed container 22 connected to the separator, which is arranged to be transported to the surface vessel for emptying. The container 22, when filled, may be replaced with a new one and brought up to the surface for further processing of the separated material. The drilling rig may comprise several containers for separated material. Preferably the containers 22 are passed through lock arrangements (not shown) as they go into and out of the drilling rig 1.

The invention claimed is:

1. A drilling rig device comprising:

a submerged drilling rig that is sealed and enclosed against the surroundings, and which is anchorable to the seabed;

a circulation system attached to the drilling rig for circulating liquid in the drilling rig such that the drilling rig is liquid-filled in use; and a separator forming part of the circulation system and in communication with the drilling rig that is arranged to separate material discharged from drilling operations performed by the submerged drilling rig from the liquid.

2. The device in accordance with claim 1, wherein the hydrostatic pressure inside the drilling rig is lower than that outside the drilling rig.

3. The device in accordance with claim 1, further comprising a container for receiving the separated material transferred from the separator.

4. The device in accordance with claim 3, wherein the container is replaceable.

5. The device in accordance with claim 1, wherein the separator forms part of a circulation system for the liquid.

6. The device in accordance with claim 5, wherein the inlet to the circulation system communicates with one of an upper or lower sections of the drilling rig, while the outlet from the circulation system communicates with the other of the upper or lower section of the drilling rig.

7. The device in accordance with claim 1, wherein the drilling rig is anchorable to the seabed with suction anchors provided on the drilling rig.

* * * * *